US009738443B2

(12) United States Patent
Ballard

(10) Patent No.: US 9,738,443 B2
(45) Date of Patent: Aug. 22, 2017

(54) VENTED TRASH RECEPTACLE

(71) Applicant: Scott Leroy Ballard, Kenosha, WI (US)

(72) Inventor: Scott Leroy Ballard, Kenosha, WI (US)

( * ) Notice: Subject to any disclaimer, the term of this patent is extended or adjusted under 35 U.S.C. 154(b) by 0 days.

(21) Appl. No.: 13/831,817

(22) Filed: Mar. 15, 2013

(65) Prior Publication Data

US 2014/0263347 A1 Sep. 18, 2014

(51) Int. Cl.

| | |
|---|---|
| ***B65D 43/26*** | (2006.01) |
| ***B65F 1/06*** | (2006.01) |
| *B65F 1/16* | (2006.01) |

(52) U.S. Cl.

CPC ..... *B65F 1/068* (2013.01); *B65D 43/26* (2013.01); *B65D 43/262* (2013.01); *B65F 1/06* (2013.01); *B65F 1/1623* (2013.01); *B65F 2210/181* (2013.01)

(58) Field of Classification Search

CPC ..... B65F 2210/181; B65F 1/06; B65F 1/163; B65F 1/1623; B65F 1/16; B65F 1/068; B65D 43/26; B65D 43/262

USPC ..... 220/908, 908.1, 495.01, 495.04, 495.05, 220/745, 913, 694, 729, 495.06, 264, 263, 220/262, 260, 823, 822, 820, 816, 812, 220/810; D34/9, 8, 7

See application file for complete search history.

(56) References Cited

U.S. PATENT DOCUMENTS

| | | | | |
|---|---|---|---|---|
| 5,265,755 | A | 11/1993 | McArthur, Jr. et al. | |
| 5,388,717 | A | 2/1995 | LeVasseur | |
| 5,628,424 | A * | 5/1997 | Gola | 220/495.07 |
| 5,690,247 | A * | 11/1997 | Boover | B65F 1/068 220/495.11 |
| 5,803,303 | A | 9/1998 | Timm | |
| 6,015,063 | A | 1/2000 | Poliquin | |
| 6,199,714 | B1 * | 3/2001 | Thompson | 220/495.07 |
| 6,471,221 | B1 | 10/2002 | McGarry | |
| 6,554,151 | B1 * | 4/2003 | Brennan | B65F 1/06 220/495.04 |
| 6,594,876 | B1 | 7/2003 | Stastny | |
| 6,736,281 | B2 | 5/2004 | Joseph | |
| 7,285,928 | B1 * | 10/2007 | Jolly et al. | 318/280 |
| 7,712,623 | B2 | 5/2010 | Wentz et al. | |
| 8,074,823 | B1 | 12/2011 | Steidinger, III | |
| 2006/0138148 | A1 * | 6/2006 | Mena | B65F 1/06 220/495.04 |

(Continued)

*Primary Examiner* — Robert J Hicks
*Assistant Examiner* — Kareen Rush

(57) ABSTRACT

A trash receptacle with foot pedal actuated vented shoes that eliminate the vacuum created from a full flexible trash liner. Closeable side vents are actuated mechanically and are connected via linkages to the foot pedal mounted near the bottom of the receptacle. The foot pedal which is located at the bottom of the container is used to open side vents when pressure is applied. The opening vents allow air to flow freely into the receptacle and close when not in use to prevent liquid and odors from escaping. The receptacle has a closed bottom and a open top. A removeable lid is provided to close the top. In addition, the manually actuated foot pedal serves to keep trash receptacle in place while trash liners are being inserted or removed. Various alternatives of the present waste receptacle are disclosed featuring different configurations of the shape of the receptacle and the connecting linkages.

6 Claims, 5 Drawing Sheets

(56) References Cited

U.S. PATENT DOCUMENTS

| | | | |
|---|---|---|---|
| 2011/0253724 | A1 | 10/2011 | Kastner |
| 2012/0217242 | A1 | 8/2012 | Dyer et al. |
| 2012/0312828 | A1 | 12/2012 | Herndon |

* cited by examiner

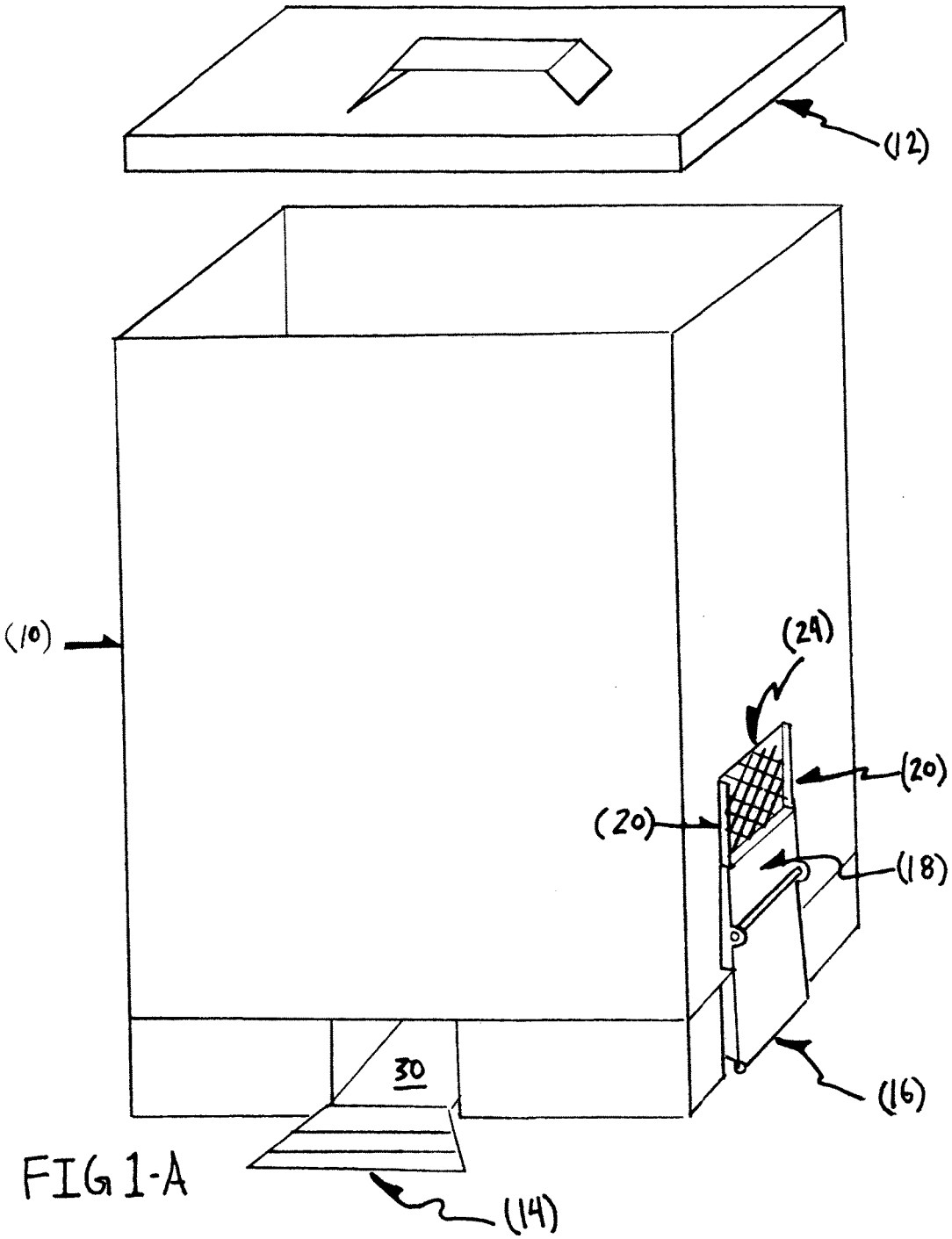
FIG 1-A

FIG 1-B
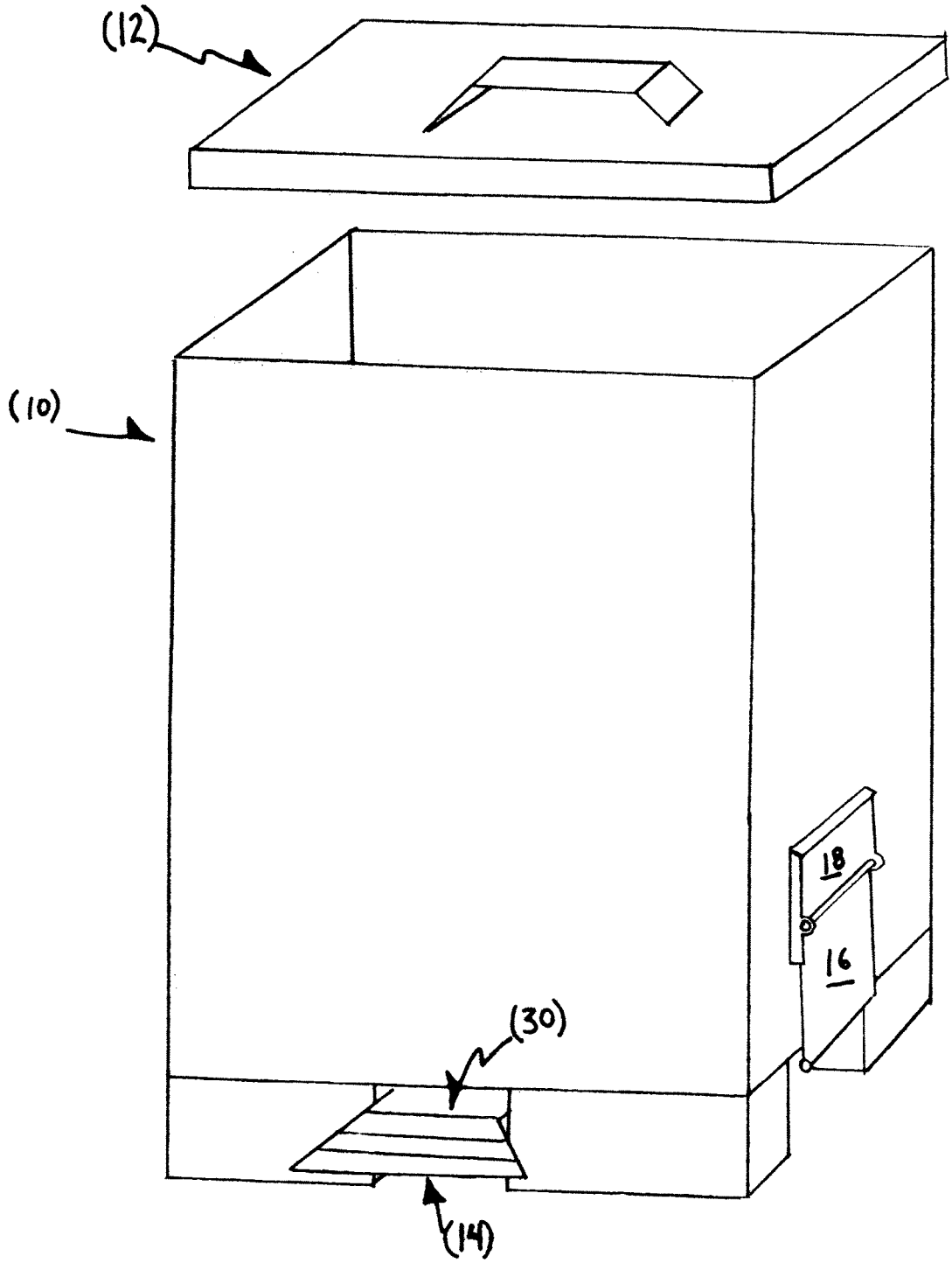

FIG 1-C
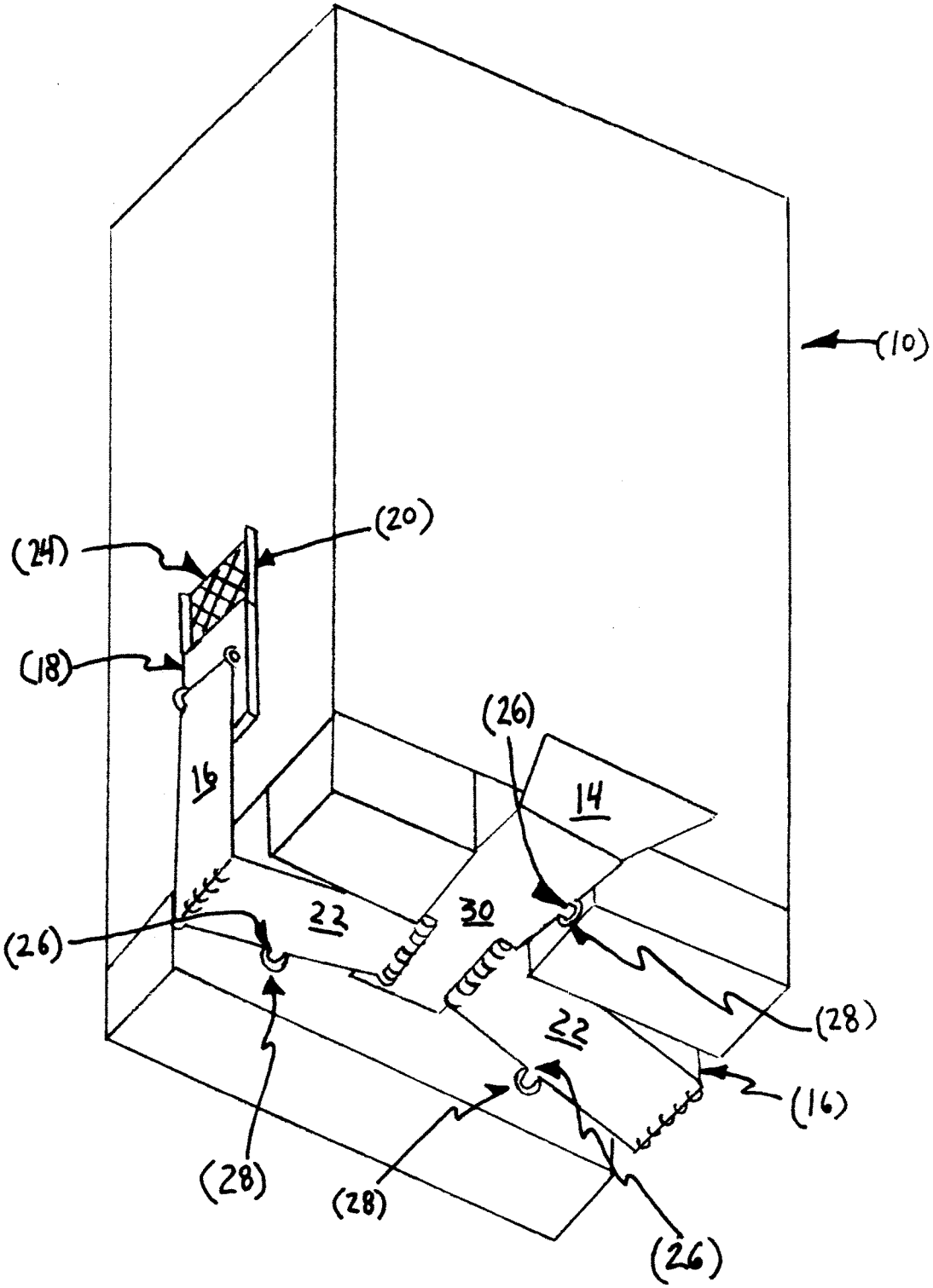

FIG 1-D
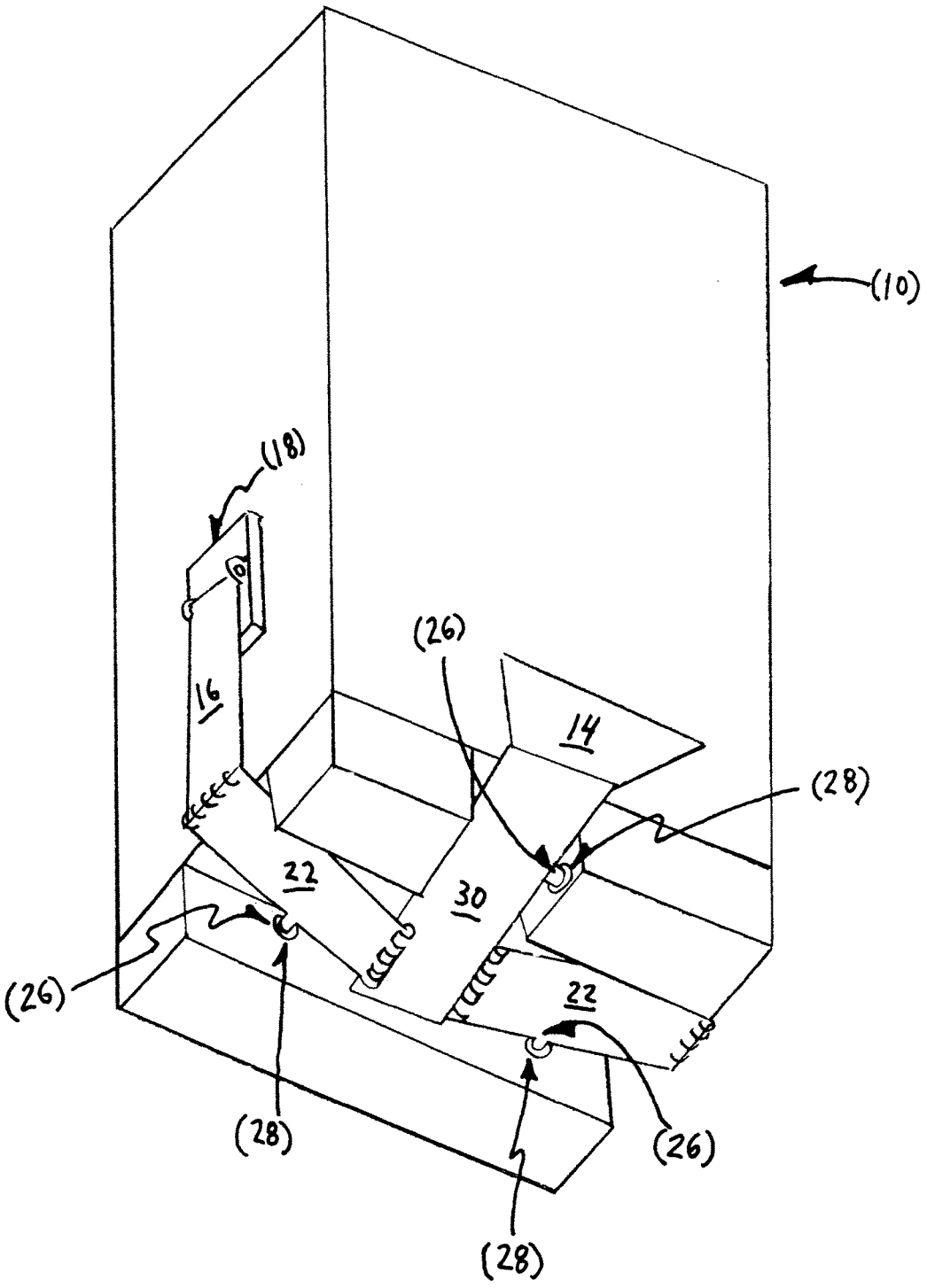

VENTED TRASH RECEPTACLE

CROSS-REFERENCE TO RELATED APPLICATIONS

This application claims no benefit of prior provisional patent applications

FEDERALLY SPONSORED RESEARCH

Nonapplicable

SEQUENCE LISTING OR PROGRAM

Nonapplicable

BACKGROUND

Prior Art

The following is a tabulation of some prior art that presently appears relevant:

| Pat. No. | Kind Code | Issue Date | Patentee |
|---|---|---|---|
| | | U.S. Patents | |
| 7,712,623 | B1 | 2010-11-05 | Wentz, et al. |
| 5,803,303 | | 1998-08-09 | Timm |
| 6,594,876 | B1 | 2003-22-07 | Stastny |
| 6,471,221 | B1 | 2002-29-10 | McGarry |
| 5,265,755 | | 1993-30-11 | McArthur Jr. et al. |
| 5,388,717 | | 1995-14-02 | LeVasseur |
| 6,736,281 | B2 | 2004-18-05 | Joseph |
| 6,015,063 | | 2000-18-01 | Poliquin |
| 8,074,823 | B1 | 2011-13-12 | Steidinger, III |
| | | U.S. patent Application Publications | |
| 20120217242 | A1 | 2012-30-08 | Dyer et al. |
| 20120312828 | A1 | 2012-13-12 | Herndon |
| 20110253724 | A1 | 2011-20-10 | Kastner |

This application relates to trash receptacles and the means to alleviate or reduce the vacuum that is created when a full flexible trash bag liner is removed from the receptacle.

A problem occurs when removing a full trash bag liner in that a vacuum is created between the bottom of the trash receptacle and the full trash bag liner as it is being removed. A considerable amount of effort is required to overcome the vacuum in order to remove the trash bag liner. Additionally, there is also a considerable amount of air trapped between the trash receptacle and the newly inserted empty liner which causes light garbage to remain near the top of the trash receptacle until heavier garbage can be placed in the liner. There also exists a need that has not been addressed by prior art, for a vacuum released vent that closes to prevent odor or rodents from entering the trash receptacle. The present invention meets this need by providing several closeable vent shoes. The shoes are located on each side of the receptacle which will allow excess air inside the receptacle in order to break the vacuum. The vent shoes are attached via linkages that connect beneath the trash can. These linkages are attached to a contiguous foot pedal and foot pedal arm. The vent shoes can either slide on molded rails or can be hinged to open and close outward and inward respectively. Other versions can include square or elliptical receptacles with vent shoes that form to the shape of the receptacle. In addition, the foot pedal used in the embodiment aids in keeping the trash receptacle planted while the flexible liner is being removed.

Several types of vented trash receptacles have been proposed—for example U.S. Pat. No. 7,712,623 (2010) to Wentz, U.S. Pat. No. 6,594,876 (2003) to Stastny, U.S. Pat. No. 5,388,717 (1995) to Le Vasseur, U.S. Pat. No. 6,736,281 (2004) to Joseph, U.S. Pat. No. 5,803,303 (1998) to Timm, and US patent application 2012/0217,242 (2012) to Dyer et al. shows a trash receptacle vent system that has permanently open vents. These vents can either extend along the longitudinal axis of the trash can or open at the bottom. None of the prior art having adequately addressed the above-stated problem of preventing odors form exiting. Also, U.S. Pat. No. 6,471,221 (2002) to McGarry has a foot cavity which will allow the trash can to remain in place but fails to address the issue of preventing a vacuum while the trash liner is being removed. U.S. Pat. No. 6,015,063 (2000) to Poliquin, U.S. Pat. No. 8,074,823 (2011) to Steidinger, III and US patent applications 2012/0312828 (2012) to Herdon and 2011/0253724 (2011) to Kastner require the installation of vent tubing but fail to properly address the issue of odor. In addition, inserting any object between a receptacle wall and a full flexible liner can possibly cause damage to the liner and also become cumbersome to operate. Finally, U.S. Pat. No. 5,265,755 (1993) to Mc Arthur, Jr. et al. provides a closeable vent which prevents odors and liquids from escaping but does not hold the receptacle in place when removing a large full trash liner. Therefore a vented trash receptacle with a mechanically operated foot pedal and closeable vents is the desired solution.

SUMMARY

In accordance with one embodiment a vented trash receptacle comprises of a normal size garbage can with a lid. At the bottom of the trash receptacle is a foot pedal that when pressed, opens a plurality of vent shoes on either side of the receptacle. The foot pedal can be depressed when placing an empty bag inside the receptacle and pressed when removing a full liner. Various alternatives can be produced. The shape of the trash can and the operation of the vent shoes can be altered. The vent shoes can either slide up or down to open or open outward away from the trash can. In either situation the operations of the vent shoes will be controlled by the foot pedal.

DRAWINGS

FIG. 1A is perspective view of the first embodiment. It shows the right front portion of the trash receptacle with the vent shoes in the open position. The foot pedal is visible and also the right portion of the vent shoe and connecting linkage. A lid is also seen in the open position.

FIG. 1B is perspective view of the first embodiment. It shows the right front portion of the trash receptacle with the vent shoes in the closed position.

FIG. 1C is a bottom view of the front left portion of the trash receptacle. In this view the foot pedal which actuates the vents can be seen. The left side vent shoe can also be seen. Additionally, the entire linkage system can be viewed from this angle displaying the horizontal and vertical linkages. In this view the vent shoe is in the open position allowing air to flow into the vent opening.

FIG. 1D is the same view as FIG. 1C except the vent shoe is in the closed position.

REFERENCES NUMERALS

Figure 2:
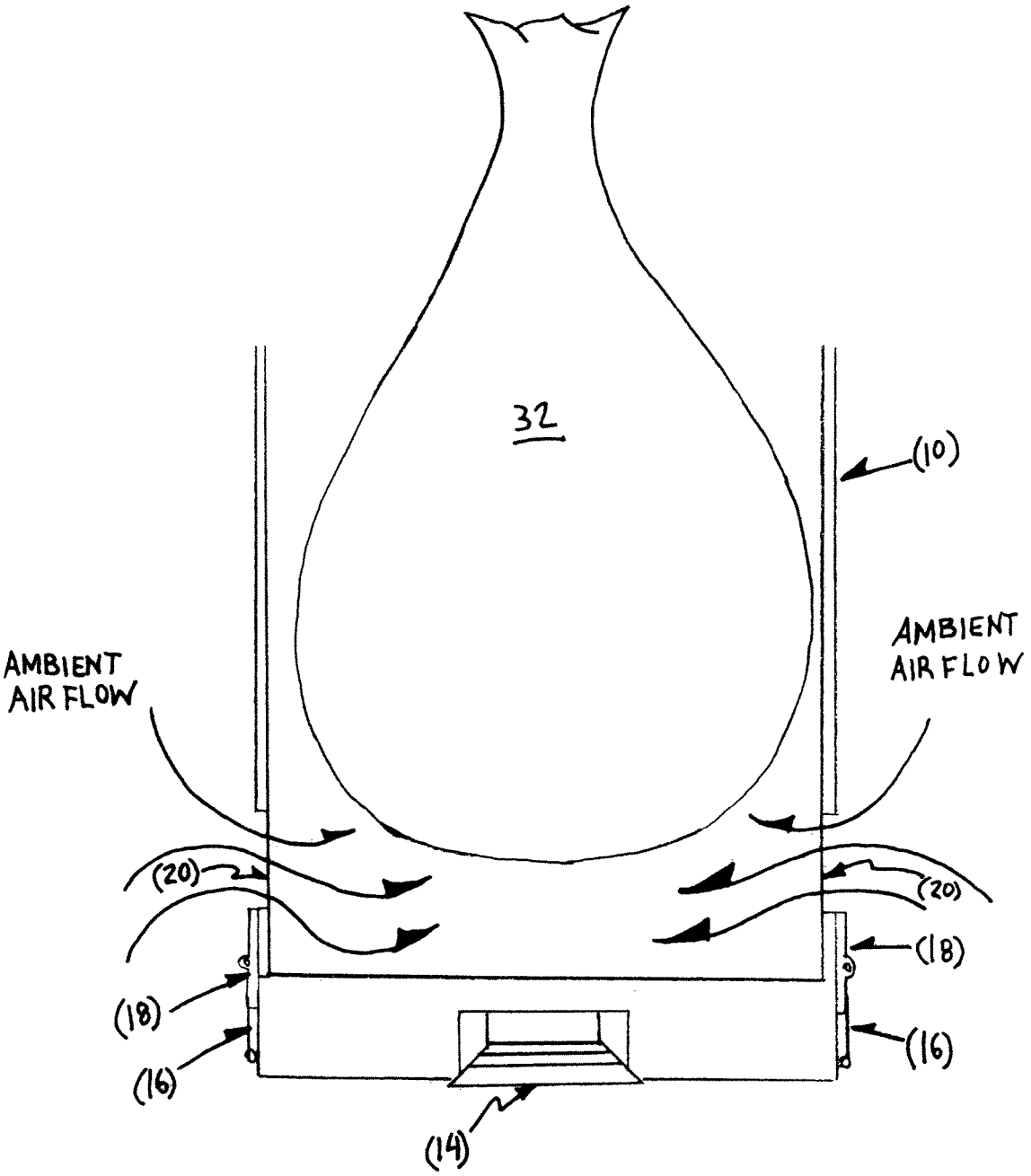
FIG. 2 is a cross sectional view of FIG. 1 having a full flexible trash liner being remove while the vents are open.

| | |
|---|---|
| 10 Trash Receptacle | 12 Lid |
| 14 Foot Pedal | 16 Verical Arm Linkage |
| 18 Vent Shoe | 20 Guide Rail |
| 22 Horizontal Arm linkage | 24 Vent Opening |
| 26 Pin | 28 Hole |
| 30 Foot Pedal Arm | 32 Flexible liner |

Detailed Description—FIGS. 1A, 1B, 1C, 1D and FIG. 2—First Embodiment One embodiment of the enclosure is illustrated in FIGS. 1A and 1B (right front view) and FIGS. 1C, and 1D (left front bottom view). FIG. 1 shows a vented trash can (10) with closeable vents shoes (18) on either side of the receptacle that move up and down and is held in place by guide rails (20) on either side. The vent shoe (18) is connected to a moveable vertical arm linkage (16) that moves vertically and has very little lateral movement. Vertical arm linkage (16) is connected to a horizontal arm linkage (22) which can be viewed in FIGS. 1C and 1D. Identical linkages of equal length are connected in the same fashion for both the left and the right side of the receptacle. Horizontal arm linkages (22) connects to the foot pedal arm (30) beneath the receptacle in the center of the trash receptacle. Each horizontal arm linkage (22) has a pin (26) on either side that extends outward perpendicular to the arm linkage. Each pin (26) is contiguous to the horizontal arm linkage (22). The pins (26) are located at a position approximately half the length of the horizontal arm linkage (22) and extend outward and perpendicular on each side. Foot pedal (14) is contiguous to the foot pedal arm (30). The foot pedal arm (30) has a pins (22) on either side that extends outward perpendicular to the foot pedal arm (30) at a location approximately half the length of the foot pedal arm (30). Each pin (26) fits into a prefabricated hole (28) at the very bottom of the trash receptacle. Each horizontal arm linkage (22) connects to the vertical arm linkage (16). The opposite end of the vertical arm linkage (16) is connected to the vent shoe (18). Each vent shoe (18) is slotted on either side so that they can move vertically along rails (20) located on either side of both shoes. The guide rails (20) are permanently molded to the trash receptacle (10). Trash receptacle (10), as shown in FIGS. 1-A through 1-D, and FIG. 2, are made of plastic material, however other conventional materials may be used to construct the trash receptacle. The size of the trash receptacle (10) may be varied to accommodate the use thereof in different applications, i.e. in residential and commercial applications.

I currently contemplate the bottom of the embodiment be premolded to fit the foot pedal arm (30) and both horizontal arm linkages (22) with holes (28) also prefabricated in the manner shown but other ways of attachment are suitable. Additionally I also contemplate this embodiment to be rectangle in shape but find other shapes like oval to be acceptable.

Operation

The manner of using the vented trash receptacle to remove trash bag liners without creating suction and to aid in holding the trash can in place while the refuse liner is being removed. Stepping on the foot pedal (14) creates a downward force at the point of impact and causes the foot pedal arm (30) to rotate around the perpendicular pins (26) which are slotted into each hole (28). The downward force creates an upward motion on the opposite end of the foot pedal arm (30). Both horizontal arm linkages (22) connect at the foot pedal arm (30) at the non foot pedal end and the preferred embodiment is connected via a hinge that can snap into place. Upward pressure from the foot pedal arm (30) causes the connecting horizontal arm linkages (22) to move up in unison and causes the opposite end to move down. The downward motion creates a downward force at the base of the vertical arm linkage (16). This downward motion causes the attached vent shoe (18) to move down exposing the vent. Air is then allowed to be sucked into the trash receptacle as the refuse liner (32) is being pulled out. The trash can is held firmly in place by the downward force on the foot pedal (14). The vent shoes (18) are guided to the open and closed position by guide rails (20).

Description and Operation of Alternative Embodiments

The embodiment listed above is the preferred embodiment but should not be limited to household garbage cans. An alternative embodiment is used in the industrial arena and lawn and leaf collection. A large size version similar to a 55 gallon trash receptacle can be be made using the same idea. By venting a large size trash can in this manner will allow consumers to use industrial size trash liners without having concern for difficulty removing a fully loaded flexible liner due to a large vacuum that is created.

CONCLUSION RAMIFICATIONS AND SCOPE

Although the description shown above is detailed with many specificities, these should not be construed as limiting the scope of the invention but as merely providing illustrations of some of the presently preferred embodiments of this invention. For example the connecting linkage can be placed in a manner so as to allow the vent shoes (18) to slide up to the open position. The vent shoe (20) can be operating in such a manner as to allow the shoes to open outward. The trash receptacle (10) and any parts heretofore can be made of any durable material used to construct items of similar capacity. The trash receptacle can also me molded in any size or shape.

I claim:

1. A mechanically operated vented trash receptacle of sufficient size to accommodate the removal of a flexible garbage bag liner of varying sizes, comprising:

(a) an essentially rigid container having four sidewalls and plurality of vents that can be operated mechanically through connecting linkages of equal length and (b) means for joining said linkages of equal length at right angles to a mechanically operated device such that said device can manipulate said vents.

2. A mechanically operated vented trash receptacle of sufficient size to accommodate the removal of a flexible garbage bag liner of varying sizes, comprising:

(a) an essentially rigid container having four sidewalls and plurality of vents of equal size that can be operated mechanically through connecting linkages of equal length and (b) means for joining said linkages of equal length at right angles to a mechanically operated device such that said device can manipulate said vents.

3. The mechanically operated vented trash receptacle of claim 2 wherein said vents are connected to a plurality of horizontal and vertical linkages of equal lengths that are connected to a mechanically operated foot pedal wherein the said foot pedal, horizontal, and vertical linkages are connected by molded hinges and said linkages and said foot pedals are made of any durable material to with stand normal wear and tear.

4. The mechanically operated vented trash receptacle of claim 2 wherein a foot pedal is used to manipulate said linkages in such fashion as to mechanically open and closed said vents.

5. The mechanically operated vented trash receptacle of claim 2 wherein said vents can be made to slide open or open laterally.

6. The mechanically operated vented trash receptacle of claim 2 wherein said mechanically operated vented trash receptacle can be used in lawn and leaf applications or industrial applications.

* * * * *